US011492795B2

(12) United States Patent
Williams et al.

(10) Patent No.: US 11,492,795 B2
(45) Date of Patent: Nov. 8, 2022

(54) BALLROOM-STYLE CLEANROOM ASSEMBLED FROM MODULAR BUILDINGS

(71) Applicant: G-CON Manufacturing, Inc., College Station, TX (US)

(72) Inventors: R. Blake Williams, College Station, TX (US); Mark P. Taylor, Philadelphia, PA (US)

(73) Assignee: G-CON Manufacturing, Inc., College Station, TX (US)

( * ) Notice: Subject to any disclaimer, the term of this patent is extended or adjusted under 35 U.S.C. 154(b) by 76 days.

(21) Appl. No.: 17/008,255

(22) Filed: Aug. 31, 2020

(65) Prior Publication Data

US 2022/0064935 A1 Mar. 3, 2022

(51) Int. Cl.

| | |
|---|---|
| ***E04B 1/348*** | (2006.01) |
| ***E04H 1/00*** | (2006.01) |
| ***E04H 1/12*** | (2006.01) |

(52) U.S. Cl.

CPC ..... *E04B 1/34869* (2013.01); *E04B 1/34846* (2013.01); *E04B 1/34861* (2013.01);

(Continued)

(58) Field of Classification Search

CPC ..... B01L 1/52; E04H 5/02; E04H 3/08; F24F 3/167

See application file for complete search history.

(56) References Cited

U.S. PATENT DOCUMENTS

| | | | |
|---|---|---|---|
| 1,967,511 | A | 7/1934 | Meyer |
| 1,991,536 | A | 2/1935 | Austin |

(Continued)

FOREIGN PATENT DOCUMENTS

| | | | |
|---|---|---|---|
| CN | 1373824 | A | 10/2002 |
| CN | 201281413 | | 7/2009 |

(Continued)

OTHER PUBLICATIONS

"Clean-Room Products and Equipment", Medical Device Technology, vol. 16, Online Available at: http://search.proquest.com/docview/195254246?accountid =142944, Jan.-Feb. 2005, pp. 43-44.

(Continued)

*Primary Examiner* — Gisele D Ford

(74) *Attorney, Agent, or Firm* — Kilpatrick Townsend & Stockton LLP

(57) ABSTRACT

A rapidly deployable cleanroom is constructed from multiple modular building sections that are side-by-side and have similarly sized lengths, as well as user-accessible panels in multiple of them for air, water, power, networking, and other utilities at a similar internal location along their lengths. The utility panels can be standardized such that each panel is substantially identical to one another. The modular building sections can be drawn together using tension cables within lateral hollow extruded structural tubes beneath and/or above the cleanroom, the tension system utilizing jack-screws to pull everything tight. Because the utility panels are at the same longitudinal location in the building sections, the joined structure and resulting open space "ballroom" style cleanroom has the utility panels aligned with each other inside the cleanroom.

20 Claims, 7 Drawing Sheets

(52) U.S. Cl.
CPC ..... *E04H 1/005* (2013.01); *E04H 1/1205* (2013.01); *E04H 2001/1283* (2013.01)

(56) References Cited

U.S. PATENT DOCUMENTS 2,098,111 A 11/1937 Sconce
2,156,859 A 5/1939 Lowe
2,168,725 A 8/1939 Whelan
3,115,819 A 12/1963 Mahlmeister et al.
3,378,963 A 4/1968 Obata
3,456,829 A 7/1969 Glassmeyer
3,470,871 A 10/1969 Shoen
3,623,283 A 11/1971 Abromavage et al.
3,638,404 A * 2/1972 Moll ..... E04H 5/02 55/484
3,638,641 A 2/1972 Abromavage et al.
3,678,639 A 7/1972 Panitz
3,742,932 A 7/1973 Greenspan
3,756,342 A 9/1973 Burdick
3,766,844 A 10/1973 Donnelly et al.
4,255,912 A 3/1981 Kovacs
4,267,769 A 5/1981 Davis et al.
4,304,224 A 12/1981 Fortney
4,327,529 A 5/1982 Bigelow, Jr. et al.
4,409,889 A * 10/1983 Burleson ..... F24F 3/167 55/385.2
4,549,472 A 10/1985 Endo et al.
4,554,766 A 11/1985 Ziemer et al.
4,599,829 A 7/1986 DiMartino, Sr. et al.
4,667,579 A 5/1987 Daw
4,667,580 A 5/1987 Wetzel
4,682,418 A 7/1987 Tuss et al.
4,693,175 A 9/1987 Hashimoto
4,694,736 A 9/1987 Yamagata et al.
4,731,961 A 3/1988 Bona
4,820,931 A 4/1989 Dunbar
4,850,268 A 7/1989 Saito et al.
4,869,156 A 9/1989 Hutton
4,883,512 A 11/1989 Griffis
4,923,352 A 5/1990 Tamura et al.
5,029,518 A 7/1991 Austin
5,058,491 A 10/1991 Wiemer et al.
5,096,477 A 3/1992 Shinoda et al.
5,125,203 A 6/1992 Daw
5,128,855 A 7/1992 Hilber et al.
5,152,814 A * 10/1992 Nelson ..... F24F 3/167 55/385.2
5,163,517 A 11/1992 Kozai et al.
5,195,922 A 3/1993 Genco
5,256,105 A 10/1993 Austin
5,259,812 A 11/1993 Kleinsek
5,279,632 A 1/1994 Decker et al.
5,326,316 A 7/1994 Hashimoto et al.
5,344,365 A 9/1994 Scott et al.
5,350,336 A 9/1994 Chen et al.
5,474,411 A 12/1995 Schoenfeld et al.
5,511,594 A 4/1996 Brennan et al.
5,562,539 A 10/1996 Hashimoto et al.
5,626,786 A 5/1997 Huntington et al.
5,641,354 A 6/1997 Sakauchi et al.
5,656,491 A 8/1997 Cassani et al.
5,706,846 A 1/1998 Sutton
5,713,791 A 2/1998 Long et al.
5,735,639 A * 4/1998 Payne ..... B65D 90/0013 588/259
5,752,985 A 5/1998 Nagafune et al.
5,795,356 A 8/1998 Leveen
5,941,846 A 8/1999 Duffy et al.
6,044,596 A 4/2000 Driggett
6,132,309 A 10/2000 Panelli et al.
6,179,358 B1 1/2001 Hirayama
6,179,522 B1 * 1/2001 Sanford ..... E04H 5/02 588/259
6,196,514 B1 3/2001 Kienholz
6,304,005 B1 10/2001 Aoki et al.
6,360,494 B1 3/2002 Emerson
6,394,523 B1 5/2002 Yoo et al.
6,397,755 B1 6/2002 Kamler
6,450,411 B1 9/2002 Rash et al.
6,512,384 B1 1/2003 Lagowski et al.
6,602,128 B1 8/2003 Spengler
6,602,457 B1 8/2003 Lee et al.
6,634,149 B2 10/2003 Cates et al.
6,688,055 B2 2/2004 Lindsley
6,869,457 B2 3/2005 Nakagawa
6,925,761 B1 8/2005 De La Marche
6,960,236 B1 11/2005 Tamura et al.
6,969,102 B2 11/2005 Orischak et al.
7,022,009 B2 4/2006 Kim
7,083,515 B2 * 8/2006 Rapisarda ..... E04B 5/48 52/220.8
7,160,717 B2 1/2007 Everett
7,162,833 B2 1/2007 Faris
7,222,246 B2 5/2007 Pomaranski et al.
7,272,733 B2 9/2007 Pomaranski et al.
7,323,025 B2 1/2008 Weidner
7,326,355 B2 * 2/2008 Graetz ..... A61M 1/0236 141/10
7,472,513 B2 1/2009 Bula
7,511,960 B2 3/2009 Hillis et al.
7,527,664 B2 5/2009 Jackson
7,586,420 B2 9/2009 Fischer et al.
7,707,931 B2 * 5/2010 Garrett ..... A23B 4/005 99/534
7,724,513 B2 5/2010 Coglitore et al.
7,827,738 B2 11/2010 Abrams et al.
7,861,102 B1 12/2010 Ranganathan et al.
7,934,124 B2 4/2011 Bechtolsheim et al.
7,985,382 B1 7/2011 Henry et al.
8,001,730 B2 8/2011 Wallance
8,061,080 B2 11/2011 Loebl et al.
8,065,560 B1 11/2011 Patil
8,147,301 B2 4/2012 Ghattas
8,239,340 B2 8/2012 Hanson
8,322,086 B2 12/2012 Weber
8,371,912 B2 2/2013 Ozeki
8,397,441 B2 3/2013 Wallance
8,479,038 B1 7/2013 Patil
8,584,349 B2 11/2013 Scannon et al.
8,656,670 B2 * 2/2014 Mouzannar ..... E04H 3/08 52/234
8,826,600 B2 9/2014 Wallance
8,854,349 B2 10/2014 Eom
9,115,504 B2 8/2015 Wallance
9,187,894 B2 11/2015 Zadok et al.
9,353,543 B2 5/2016 Lam
9,518,748 B2 12/2016 Holtz et al.
9,671,798 B2 6/2017 Hodge et al.
9,765,980 B2 9/2017 Holtz et al.
9,795,957 B2 * 10/2017 Holtz ..... B01L 1/04
10,006,218 B2 6/2018 Marinoni
10,161,147 B2 * 12/2018 Jornitz ..... E04H 1/005
10,371,394 B2 * 8/2019 Wernimont ..... F24F 3/167
10,654,036 B2 5/2020 Holtz et al.
2002/0174888 A1 11/2002 Brown
2003/0045226 A1 3/2003 Yokoyama et al.
2003/0140555 A1 7/2003 Saether
2004/0159051 A1 8/2004 Lam
2004/0194484 A1 10/2004 Zou et al.
2005/0082445 A1 4/2005 Groves
2005/0091916 A1 5/2005 Faris
2005/0124010 A1 6/2005 Short et al.
2005/0154494 A1 7/2005 Ahmed
2005/0193643 A1 * 9/2005 Pettus ..... F24F 3/167 52/79.1
2006/0107635 A1 5/2006 Homan et al.
2006/0217056 A1 9/2006 Gomi et al.
2006/0234621 A1 10/2006 Desrochers et al.
2007/0039260 A1 2/2007 Haddad
2007/0089854 A1 4/2007 Jaisinghani
2007/0130844 A1 6/2007 Arts et al.
2007/0132262 A1 6/2007 Chui Peng Sun et al.
2007/0167126 A1 7/2007 Ghattas
2007/0228692 A1 10/2007 Kern et al.

(56) References Cited

U.S. PATENT DOCUMENTS

| | | | | |
|---|---|---|---|---|
| 2007/0251145 | A1 | 11/2007 | Brusatore | |
| 2007/0253831 | A1 | 11/2007 | Lee | |
| 2008/0005976 | A1 | 1/2008 | Montaigne | |
| 2008/0047207 | A1 | 2/2008 | Lam | |
| 2008/0047224 | A1 | 2/2008 | Lam | |
| 2008/0086980 | A1 | 4/2008 | Martin | |
| 2008/0201008 | A1 | 8/2008 | Twelves et al. | |
| 2008/0302004 | A1 | 12/2008 | Lin | |
| 2009/0122533 | A1 | 5/2009 | Brukilacchio | |
| 2009/0126285 | A1 | 5/2009 | Suh et al. | |
| 2009/0199470 | A1 | 8/2009 | Capen et al. | |
| 2009/0305626 | A1 | 12/2009 | Hope | |
| 2010/0031564 | A1 | 2/2010 | Loebl et al. | |
| 2010/0112677 | A1 | 5/2010 | Onishi et al. | |
| 2010/0112926 | A1* | 5/2010 | Ozeki | F24F 9/00 55/385.2 |
| 2010/0192493 | A1 | 8/2010 | Nakai | |
| 2010/0251677 | A1* | 10/2010 | Franck | F24F 3/044 55/385.2 |
| 2010/0304658 | A1 | 12/2010 | Grcevic | |
| 2011/0053486 | A1* | 3/2011 | Holtz | B01L 1/04 29/428 |
| 2011/0217917 | A1 | 9/2011 | Sulva | |
| 2011/0219953 | A1 | 9/2011 | Schreiber | |
| 2011/0258837 | A1 | 10/2011 | Scannon et al. | |
| 2012/0077429 | A1* | 3/2012 | Wernimont | F24F 3/167 52/302.1 |
| 2012/0099035 | A1 | 4/2012 | Burgess | |
| 2012/0152800 | A1* | 6/2012 | Parzy | B01L 1/52 206/701 |
| 2012/0181869 | A1 | 7/2012 | Chapel et al. | |
| 2013/0109291 | A1* | 5/2013 | Holtz | B01L 1/04 29/428 |
| 2014/0179216 | A1 | 6/2014 | Walters | |
| 2015/0101264 | A1* | 4/2015 | Jornitz | E04B 1/34384 52/79.9 |
| 2015/0101265 | A1 | 4/2015 | Nyce et al. | |
| 2015/0159127 | A1 | 6/2015 | Guerini et al. | |
| 2016/0010883 | A1* | 1/2016 | Jornitz | F24F 13/32 29/897.3 |
| 2016/0010884 | A1 | 1/2016 | Holtz et al. | |
| 2017/0030097 | A1* | 2/2017 | Marinoni | E04H 5/02 |
| 2017/0260763 | A1 | 9/2017 | Fortin et al. | |
| 2018/0043347 | A1 | 2/2018 | Holtz et al. | |
| 2019/0145118 | A1* | 5/2019 | Gauthier | E04H 1/005 52/79.1 |
| 2020/0146186 | A1* | 5/2020 | Fotouh | E04B 2/7401 |

FOREIGN PATENT DOCUMENTS

| | | | |
|---|---|---|---|
| CN | 102884256 | A | 1/2013 |
| CN | 105723036 | A | 6/2016 |
| CN | 107002408 | A | 8/2017 |
| CN | 107371371 | A | 11/2017 |
| CN | 108884673 | A | 11/2018 |
| DE | 8913876 | | 3/1990 |
| DE | 4007740 | | 9/1991 |
| EP | 0940292 | | 9/1999 |
| EP | 2098111 | | 9/2009 |
| EP | 3263789 | | 1/2018 |
| EP | 3274524 | | 1/2018 |
| FR | 2819536 | A1 | 7/2002 |
| JP | 61101733 | | 5/1986 |
| JP | 02209526 | | 8/1990 |
| JP | 06174279 | | 6/1994 |
| JP | 06183511 | | 7/1994 |
| JP | 10077711 | | 3/1998 |
| JP | 11166269 | | 6/1999 |
| JP | 2000054654 | | 2/2000 |
| JP | 2000142211 | | 5/2000 |
| JP | 2001141274 | | 5/2001 |
| JP | 2002221464 | | 8/2002 |
| JP | 2004033498 | | 2/2004 |
| JP | 2004233021 | | 8/2004 |
| JP | 2007107779 | | 4/2007 |
| JP | 2007107830 | | 4/2007 |
| JP | 2008304989 | | 12/2008 |
| JP | 2009002634 | | 1/2009 |
| KR | 20060130383 | | 12/2006 |
| KR | 100675682 | | 2/2007 |
| TW | 200912219 | | 3/2009 |
| WO | 0002618 | | 1/2000 |
| WO | 03095765 | | 11/2003 |
| WO | 2004005170 | | 1/2004 |
| WO | 2007067656 | | 6/2007 |
| WO | 2008018671 | | 2/2008 |
| WO | 2011022325 | A2 | 2/2011 |
| WO | 2013132086 | | 9/2013 |
| WO | 2018006184 | A1 | 1/2018 |

OTHER PUBLICATIONS

"Fast-Track Clean Room Building", European Semiconductor, vol. 14, No. 3, Mar. 1992, pp. 43-45.

"Hardwall Cleanroom", HDW Series, Abtech Incorporated, p. 8.

"Pharmadule Doubles Production Capacity and Acquires Patent for Modular Biotech Plants", Pharmadule Press Release, Available Online at: http://www.pharmadule.com/pharmaduledoubles-production-capacity, Sep. 26, 2002, 1 page.

"Pneumatic Powered Load Moving Systems—Air Bearing Principle", Hovair Systems, Available Online at: https//web. archive. o rg/web/20080521 025052/http :/ /www. hovai r. com/air-bearing -info/features-and-benefits. htm, May 21, 2008, 3 pages.

"Starrco Brochure", Cleanroom Solutions, 4 pages.

"Vanguard Modular Building Systems Brochure", Astra-Zeneca Pharmaceutical Building, Dec. 9, 2004, 2 pages.

Muth , "Modular Construction: Pros and Cons for the Lab Building", Laboratory Design, Research and Development Magazine, Jun. 17, 2009, 5 pages.

Oliviera , "Factory in a Clean Room", Quality Progress, Milwaukee, vol. 23, No. 1, Available Online at: https://search.proquest.com/docview/214764942?accountid=142944, Jan. 1990, pp. 37-39.

Watkins , "Clean Rooms: Their Performance and Design", Journal of Semi-Custom Integrated Circuits, vol. 2, No. 3, Mar. 1985, pp. 36-41.

PCT/US2021/046271 , "International Search Report and Written Opinion", dated Nov. 29, 2021, 10 pages.

PCT/US2020/046143 , "International Search Report and Written Opinion", dated Dec. 2, 2020, 10 pages.

PCT/US2020/046143 , "International Preliminary Report on Patentability", dated Feb. 24, 2022, 8 pages.

* cited by examiner

BALLROOM-STYLE CLEANROOM ASSEMBLED FROM MODULAR BUILDINGS

CROSS-REFERENCES TO RELATED APPLICATIONS

NOT APPLICABLE

STATEMENT AS TO RIGHTS TO INVENTIONS MADE UNDER FEDERALLY SPONSORED RESEARCH AND DEVELOPMENT

NOT APPLICABLE

BACKGROUND

1. Field of the Invention

Embodiments of the present invention generally relate to chemical or physical laboratory clean room enclosures. Specifically, they relate to modular buildings that are joined together laterally with tension cables to form a large, ballroom-style open area in which utility connections are aligned with one another.

2. Description of the Related Art

U.S. Pat. No. 9,765,980, issued to Holtz et al., discloses a modular, self-contained, mobile clean room, also shortened to "cleanroom." About the size of a modular building, the cleanroom can be pre-fabricated in a factory and then transported by semitrailer, railcar, or cargo aircraft to a final location. Unlike non-modular buildings, such cleanrooms often employ lightweight construction, aluminum frames with steel and aluminum panels, and lack a substantial amount of heavy drywall.

Such cleanrooms can come complete with their own mechanical rooms that house heating, ventilation, and air conditioning (HVAC) air handling units, plumbing utilities, and circuit breaker panels. Ducts, piping, and electrical conduit run from the mechanical room through the walls to the cleanroom or over its ceiling to where they need to go. Additionally or alternatively, utilities can be provided directly from a surrounding "gray space" building without running through a mechanical room.

Multiple such cleanrooms can be set together in warehouses or other gray space buildings. The clean rooms can provide electricity, chilled and hot water, HVAC (heating ventilation, and air conditioning), clean gases, drainage hookups, and communications wiring. Besides their use as analysis laboratories, the mobile cleanrooms are a relatively quick way to support the manufacture of pharmaceuticals and biopharmaceuticals. Some cleanrooms are certifiable to ISO5 air purity.

Sometimes housed inside the cleanrooms are heavy, bulky laboratory and manufacturing equipment. For example, a cleanroom may contain a centrifuge, tissue culture hood, chemical handling unit, stirrer tank, chromatography column, cell sorter, bioreactor, refrigerator, freezer, incubator, biosafety cabinet, temperature cycler, vacuum, or freeze dryer. Some equipment within the cleanrooms is on heavy duty casters so that it may be repositioned to a new station or otherwise transported by rolling on the cleanroom floor. The advent of single use technology has reduced the size of equipment and reduced the need for hard piping within cleanrooms, which has opened the door for a more modular approach.

There is a need in the art for modern, transportable cleanrooms that are larger and have more flexible space than before while preserving serviceability and maintainability.

BRIEF SUMMARY

Generally, a large, open, ballroom-style of cleanroom is constructed from multiple modular building sections by tying the building sections together with tension cables. The tension wires can be run through extruded tubes under the floor. Each modular building section may have a standardized utility panel on its ceiling, floor, or walls, depending on the amount of equipment housed in it. After the modular building sections are joined together, the utility panels, which are at the same location in each building section, are connected to pipes, electrical conduit, cable raceways, HVAC ductwork, and other utilities that run laterally over the cleanrooms in a shortest distance between them.

During assembly, air bearings beneath the modular building sections are pressurized so that the sections can be aligned and pushed together by hand. The tension cables are fed through the extruded tubes, which provide structural support to the respective section, and then tightened with jackscrews to draw the sections together snugly.

Some embodiments of the present invention are related to a rapid deployment cleanroom system including multiple modular building structures positioned side-by-side with respect to each other, each modular building structure having a longitudinal dimension and a lateral dimension, each modular building structure including a floor, a ceiling, and at least two walls defining an interior, hollow tubes extending laterally across the modular building structure and below the floor of or above the ceiling of the modular building structure, and a utility panel having a set of connections for power outlets, data, pressurized gas, and water, a longitudinal location of the utility panel within the interior of each modular building structure being substantially identical among the modular building structures, and fasteners within the hollow tubes of the modular building structures configured to join the modular building structures together, wherein the joined modular building structures form a large sealable, sterilizable cleanroom, wherein the utility panels of the modular building structures are aligned with one another in the cleanroom interior.

The fasteners can include tension cables extending through the hollow tubes and between opposite sides of the joined modular building structures. Alignment blocks can be placed between the modular building structures. Air bearings can be installed beneath the floor of each modular building structure configured to support the modular building structure on a cushion of air to facilitate joining them together.

A number and type of connections in each set can be substantially identical between utility panels in different modular building structures. The utility panels can be located on ceilings of the modular building structures. Gas pipes can extend laterally over the modular building structures and connecting the pressurized gas connections, and water pipes can be collocated with the gas pipes extending laterally over the modular building structures and connecting the water connections. Electrical conduit can extend laterally across the modular building structures and connect the power outlets, and data cables can extend laterally across the modular building structures and connect the data connections. The electrical conduit can include flexible conduit and junction boxes between the modular building structures.

Each modular building structure can further include an air vent opening to the interior, an air handling duct connected with the air vent, and the cleanroom system can include ductwork extending laterally across the modular building structures and connecting the air vents. The large sealable, sterilizable cleanroom can include an area that is uninterrupted by pillars or structural walls.

Some embodiments include a method of assembling modular building structures into a larger ballroom-style cleanroom. The method can include positioning multiple modular building structures side-by-side with respect to each other, each modular building structure having a longitudinal dimension and a lateral dimension, each modular building structure including a floor, a ceiling, and at least two walls defining an interior, hollow tubes extending laterally across the modular building structure and below the floor of or above the ceiling of the modular building structure, and a utility panel having a set of connections for power outlets, data, pressurized gas, and water, a longitudinal location of the utility panel within the interior of each modular building structure being substantially identical among the modular building structures. The method further includes removing tie down lugs from the hollow tubes, inserting a tension cable through the hollow tubes of the side-by-side modular building structures, tightening the tension cables to join the modular building structures together and form a large sealable, sterilizable cleanroom, and connecting the utility panels of the side-by-side modular building structures, wherein the utility panels of the modular building structures are aligned with one another in the cleanroom interior.

Air bearings beneath the floor of each modular building structure can be pressurized to support the modular building structure on a cushion of air during the tightening.

A number and type of connections in each set of connections can be substantially identical between utility panels in different modular building structures. The utility panels can be located on ceilings of the modular building structures.

The connecting can include connecting the pressurized gas connections with gas pipes extending laterally over the modular building structures, and connecting the water connections with water pipes collocated with the gas pipes extending laterally over the modular building structures. The connecting can include connecting the power outlets with electrical conduit extending laterally across the modular building structures, and connecting the data connections with twisted pair, coax, or other data cables extending laterally across the modular building structures. The electrical conduit can include flexible conduit and junction boxes between the modular building structures.

Each modular building structure can further include an air vent opening to the interior and an air handling duct connected with the air vent, the method further including connecting the air vents with ductwork extending laterally across the modular building structures.

The large sealable, sterilizable cleanroom can include a "ballroom" area that is uninterrupted by pillars or structural walls.

DETAILED DESCRIPTION

Figure 1:
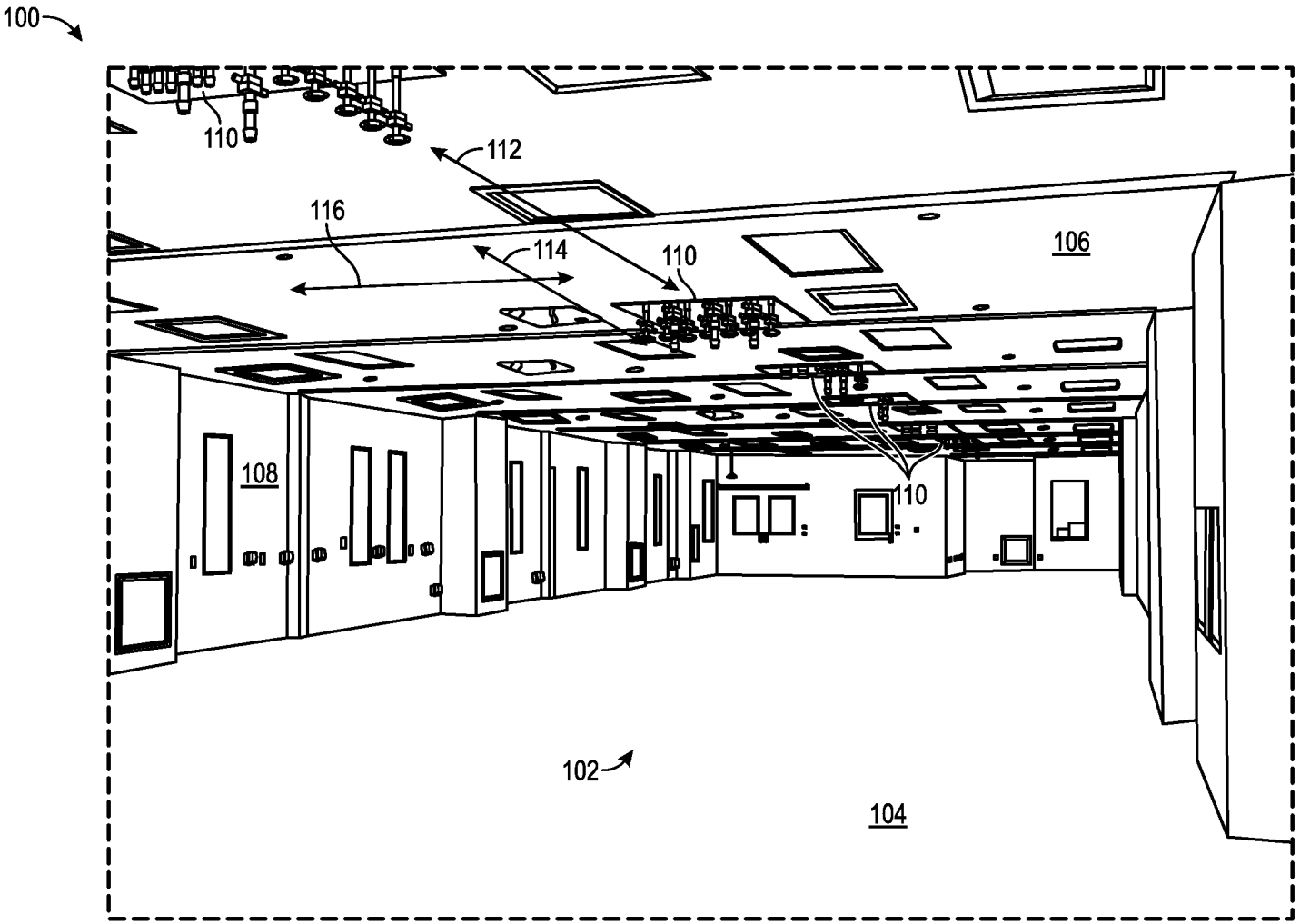
FIG. 1 illustrates an inside perspective view of a ballroom-style cleanroom in accordance with an embodiment.

Similar-length modular building structures/sections are strapped together with tension cables or other fasteners from end-to-end in order to create a larger, "ballroom-style" open room with few or no pillars or other intervening structures. Utility panels are set in the floor, walls, or ceiling of each or almost each section at the same position. When the structures are joined together, the utility panels line up.

A "ballroom-style cleanroom" includes a large interior room for personnel & equipment that is unbroken by pillars or structural walls, sealable from dust, and whose surfaces are predominantly smooth and sterilizable, or as otherwise known in the art. Such cleanrooms can include double, triple, quadruple, or greater assemblies of modular buildings that avoid major structural side walls between the modular buildings where the ballroom is and mainly have outer perimeter walls.

A "utility panel" includes a fixture on a building to provide two or more utilities, such as electrical power, computer network access, gases such as oxygen, nitrogen, carbon dioxide, and compressed air, liquid chilled water, including its supply and return, and other utilities, or as otherwise known in the art.

Air bearings that can lift each modular building structure on a warehouse floor can be set at its four corners and edges. Some commercially available air bearings are each about 45 centimeters (cm) (18 inches) in diameter and under 6.2 cm (2.4375 inches) tall. When pressurized, they can allow one or two workers to almost effortlessly move and rotate the relatively large mobile building structures Technical advantages of various embodiments are many. A ballroom-style open cleanroom allows for larger laboratory or manufacturing equipment to be mounted within than rooms that are obstructed with pillars and unmovable internal walls. The open space is flexible, allowing analysis and production items, laboratory benches and desks, to be restationed as desired. Tension cable fasteners provide the advantages of being lightweight, extremely strong, and adjustable at the installation location. Along with air bearings, they allow a small team to push together the modular building sections on a flat warehouse/gray space floor and tighten them together from one side. They do not need to be tightened from the inside, thus, preserving the cleanliness of the cleanroom, which may have elements that are factory sealed. The cables are also uninstallable or replaceable if necessary without having to access the inside of the cleanroom. Having the utility panels aligned with one another within the interior not only simplifies the layout for users, but it can minimize the length of pipes, electrical conduit, cable trays, ductwork, and other utilities necessary to connect the building. The same jigs and templates may be used to install the utility panels. Also, users may find that the utility panels are in predictable areas of the inside, simplifying the task of determining where items go and workflow procedures should be performed.

FIG. 1 illustrates an inside perspective view of a ballroom-style cleanroom. System 100 includes at least eight modular building sections joined together, their seams visible in the ceiling and on some of the walls. Each modular building section has longitudinal dimension 116, which runs the long way of each individual section, and lateral dimension 114, which runs the shorter way of each section. The modular building sections are joined side-by-side with respect to each other. Joining them together results in large sealable, sterilizable cleanroom 102.

Cleanroom 102 is defined by floor 104, ceiling 106, and walls 108. In the figure, there are no pillars or internal walls to obstruct the space, much like a ballroom. Thus, it is referred to as a "ballroom" space.

Each modular building section includes utility panel 110 on its ceiling. The utility panels include outlets for electrical power, network connectivity, chilled water for cooling, compressed air, and various purified gases. The positions of the panels are at the same longitudinal position on each of the modular building section's ceilings 106. They are also at the same lateral position on the ceiling of each section.

When the modular building sections were assembled and joined together, the utility panels aligned in line 112 with each other. This makes for a predictable, simple user experience. Wherever a particular utility is needed along the long direction of the entire room, the outlet for the utility is in a common position from the walls, directly overhead.

In the exemplary embodiment, each utility panel is standardized, such that a set of connections for the same utilities may be found on any of the utility panels. For example, there may be two chilled water outlets and two returns on every single panel. In addition, there may be four Ethernet data ports and six electrical outlets on each panel. And there may be two compressed air, one oxygen, one carbon dioxide, and one nitrogen connection. Other utilities can be provided. The number and type of connections in each set of connections are identical between the different utility panels. In other embodiments, different combinations of connections can be presented on the utility panels.

"Substantially identical" numbers or types include having a commonality of 75%, 80%, 85%, 90%, 95%, or more between the total numbers of items and types, or as otherwise known in the art. For example, a first utility panel with ten different connections and a second utility with nine different connections may be substantially identical if eight or all nine of the utilities are the same between the first and second utilities.

Figure 2:
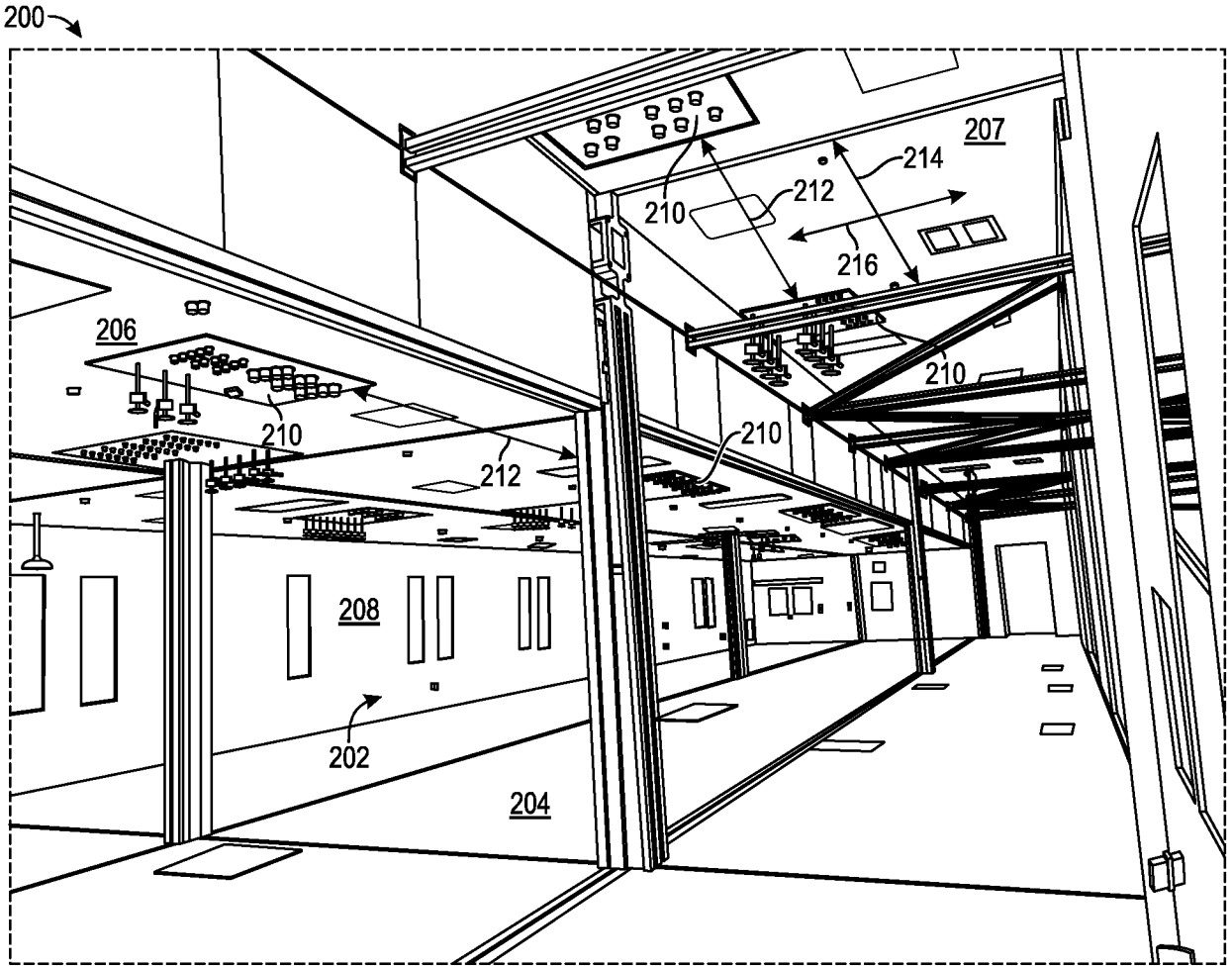
FIG. 2 illustrates an inside perspective view of a high bay cleanroom in accordance with an embodiment.

FIG. 2 illustrates an inside perspective view of a high bay cleanroom. System 200 includes several modular building sections joined together, each having a high portion as shown. Each modular building section has longitudinal direction 216 and lateral dimension 214. The modular buildings sections are joined together side-by-side to result in large sealable, sterilizable cleanroom 202. The high portion of each modular building section is aligned with the high portion of its neighbor, resulting in a relatively clear high bay area running the length of the room.

Cleanroom 202 has floor 204, low ceiling 206, high ceiling 207, and walls 208. There are four structural pillars in the view, but these still leave empty a large, unobstructed floor in the middle between the two sets of pillars, forming a ballroom with a high bay on one side.

Utility panels 210 are aligned with one another on low ceiling 206 and on high ceiling 207, running along lines 212. High ceiling 207 is the ceiling of the high bay. Like in the previous embodiment, personnel are presented with mostly common panels no matter where they are in the great space. The utility panels feature connections for various compressed cases, compressed air, chilled and hot water and returns, network connections, and power outlets, as well as alarm feeds and such.

Some utility panels can be different due to user needs. For example, in some embodiments, the high bay utility panels are different from the low ceiling utility panels. In other embodiments, several of the utility panels can be the same in a low and high section but then change to simpler or more complex utility panels at other points in the room.

Figure 3:
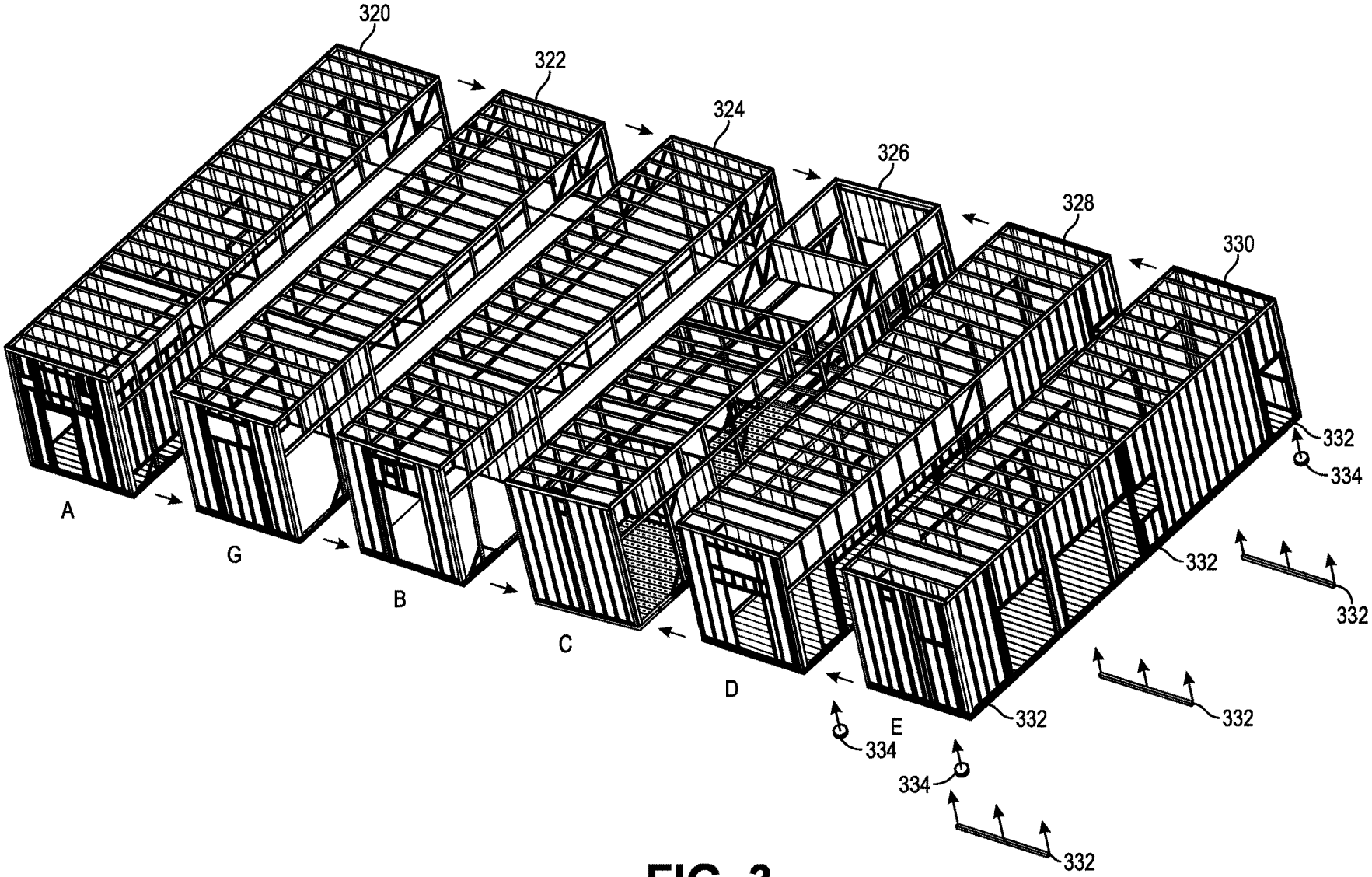
FIG. 3 is an isometric view of modular building sections before they are joined into a larger ballroom cleanroom in accordance with an embodiment.

FIG. 3 is an isometric view of modular building sections before they are joined into a larger ballroom cleanroom. Between end modular building sections 320 and 330 are sandwiched four modular building sections 322, 324, 326, and 328 for a total of six modular building structures. In the embodiment, each section is the same (longitudinal) length, (lateral) width, and height. However, their internal constructions and door and window layouts are different.

Five of the modular building sections include similarly sized maintenance/utility rooms, while end section 330 happens to have a smaller utility closet. Several units have external doorways for moving personnel and materials into and out of the cleanroom. Some units are configured so that when the sections are joined, there will be internal walls. Yet among sections 320, 322, and 324 there will be a large, internal ballroom-sized space without intervening posts or walls.

Each modular building section has a set of air bearings 334, like those shown for modular building section 330. There is at least one air bearing in each lower corner. When pressurized, the air bearings lift the modular building section on a thin cushion of air so that it may be moved by just a few installation personnel. The air bearings share a bottom space with structural elements.

Hollow, extruded tubes 332 extend laterally across the bottom of each modular building section, such as those shown for modular building section 330. In some embodiments, hollow tubes are on the top. The hollow tubes have a rounded-corner square cross section but can have other shaped cross sections as well. Being structural, the hollow tubes can house tie down lugs for travel. After unloading at a destination, the tie down lugs are removed and tension cables inserted through the hollow tubes.

Figure 4:
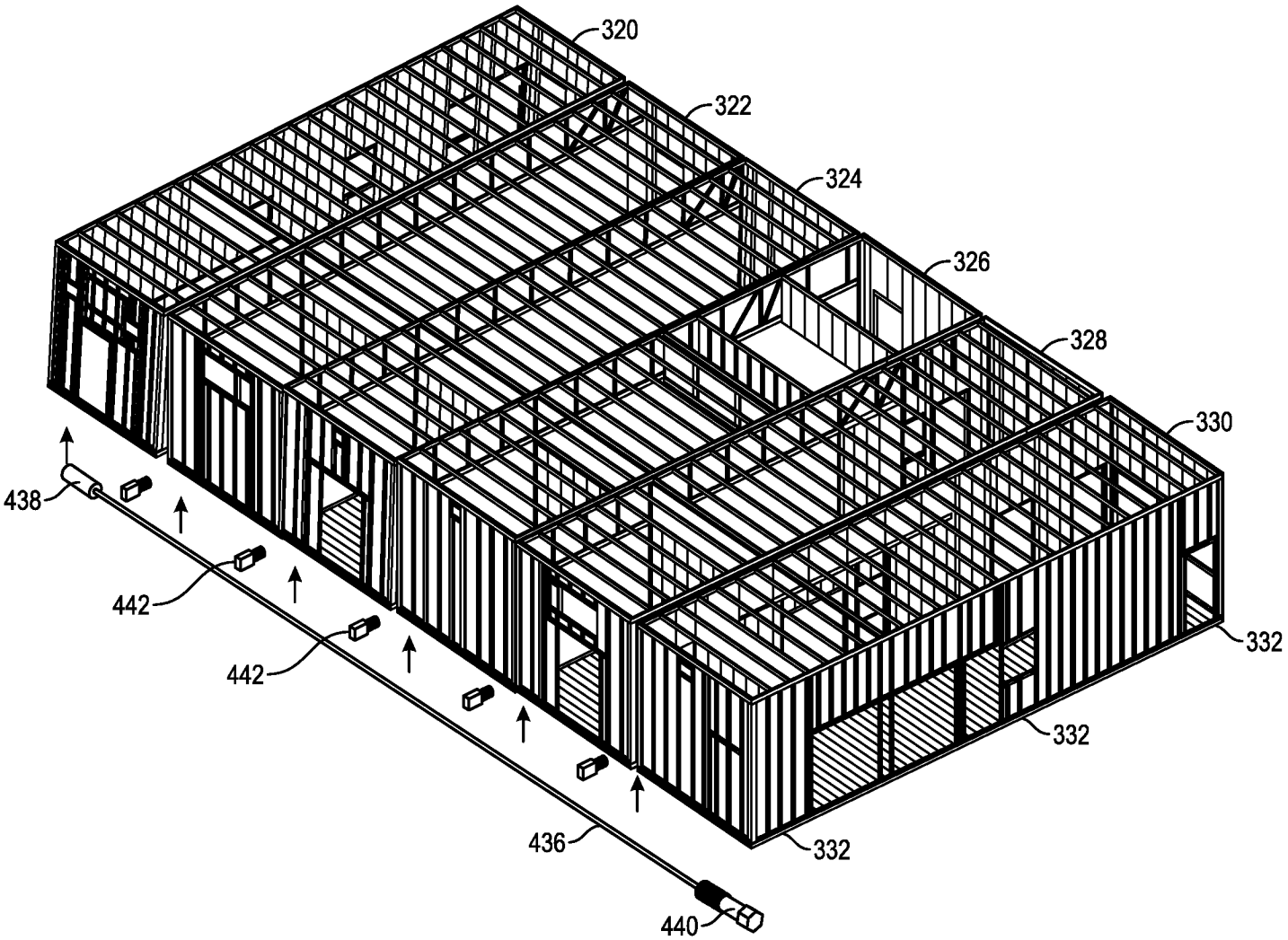
FIG. 4 is an isometric view of the modular building sections of FIG. 3 after they are joined into a larger ballroom cleanroom.

FIG. 4 is an isometric view of the modular building sections of FIG. 3 after they are joined into a larger ballroom cleanroom. Between modular building sections 320, 322, 324, 326, 328, and 330 are alignment blocks 442, which are mounted in concave C channels running the perimeter of the bottom of each modular building section. The alignment blocks ensure that the floors of the different modular building sections vertically align with one another and that the wall, doors, and other items also align, horizontally.

Tension cable 436 is run through hollow tube 332. At a far end, tension cable 436 is connected through an all thread rod to dead man's billet 438. At the near end, tension cable is connected to turnbuckle 440. Other tension cables are run through the other hollow tubes 332 with similar attachments.

When turned, turnbuckle 440, and the turnbuckles of the other tension cables, pull the tension cable tight, compressing modular building sections 320, 322, 324, 326, 328, and 330 together.

After the modular building sections are connected together into one big building, utilities connections are laid in place and connected. For example, gas pipes, water pipes, electrical conduit, and data cables are mounted laterally over the modular building sections. Because the utility panels are in the same longitudinal location on each section, less pipe, conduit, and cabling is required than if the utility panels were in different areas. Similarly, HVAC ductwork can also be laid laterally across the modular building structures and connected to air handing ducts and air vents.

Figure 5:
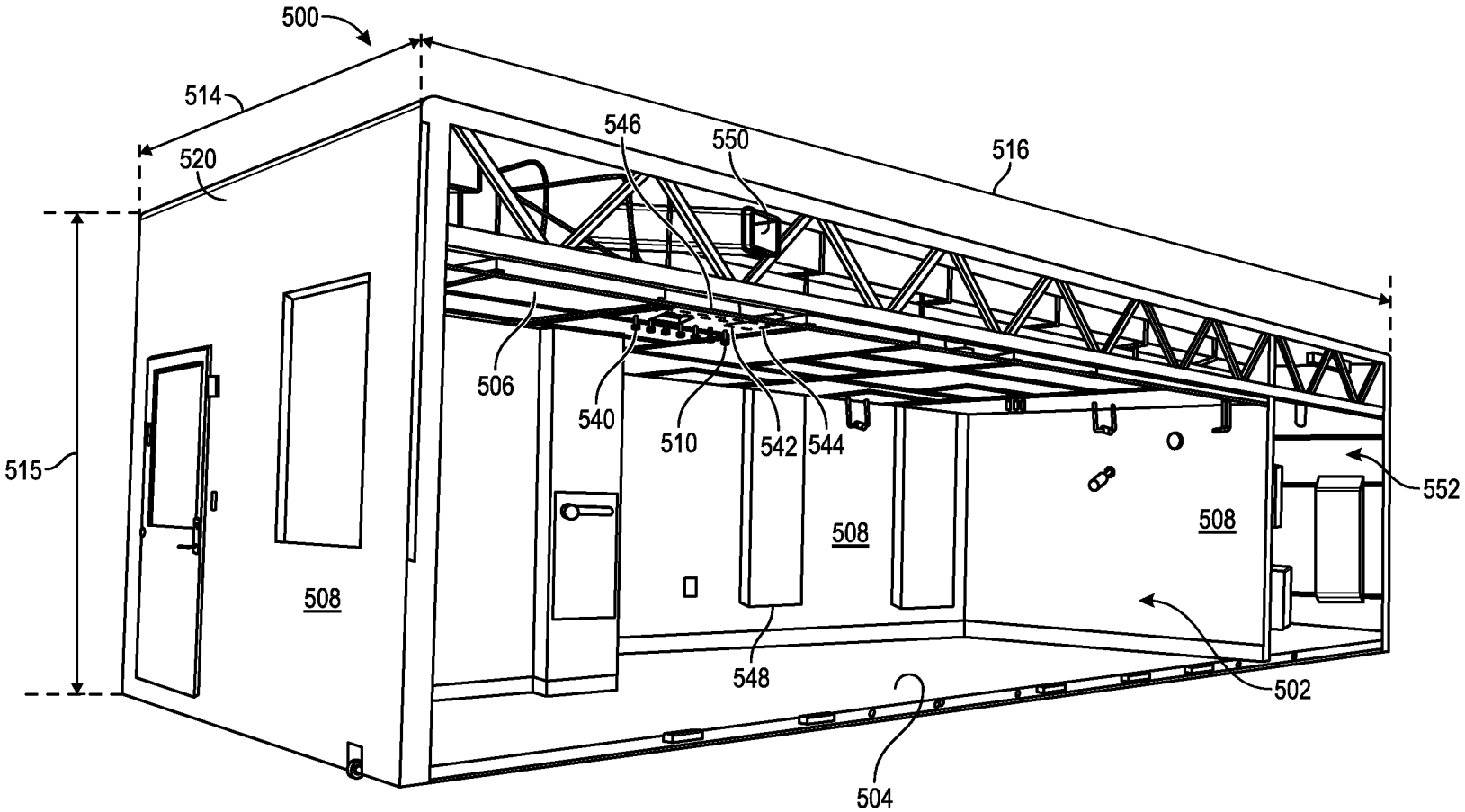
FIG. 5 is a perspective, elevation view of a modular cleanroom section in accordance with an embodiment.

FIG. 5 is a perspective, elevation view of a modular cleanroom section in accordance with an embodiment. In assembly 500, modular building section 520 has longitudinal dimension 516, lateral dimension 514, and height dimension 515. In the figure, the dimensions are shown with arrows that define the extent of the section. Besides utility room 552 at one end, modular building section 520 encloses cleanroom 502, whose bottom is defined by floor 504, sides defined by walls 508, and top defined by ceiling 506.

In the interstitial space above the ceiling is air handling duct 550, among other utility lines. Air handling duct connects to air vent 548 within the interior of cleanroom 502, providing filtered, slightly pressurized air to the cleanroom. A slight pressurization minimizes dust and other impurities from seeping in.

An "interstitial volume" or "interstitial space" is an area above a ceiling of a cleanroom and below a roof of a modular building structure surrounding the cleanroom, or as otherwise known in the art.

In ceiling 506 is set utility panel 510. Utility panel 510 hosts a set of utility connections 540, 542, 544, and 546. The connections are power outlets, Ethernet jacks, pressurized gas connections, and water outlets and returns. These four types of connections may be replicated in utility panels of other modular building structures with which modular building structure 520 will be joined.

On the roof of the modular building assembly, walkable floor panels are supported between joists. Each floor panel can be independently removable from its surrounding joists to provide for access by personnel. In the exemplary embodiment, a swath of floor panels extends an entire width and length of the unitary frame of modular building section 520.

Figure 6:
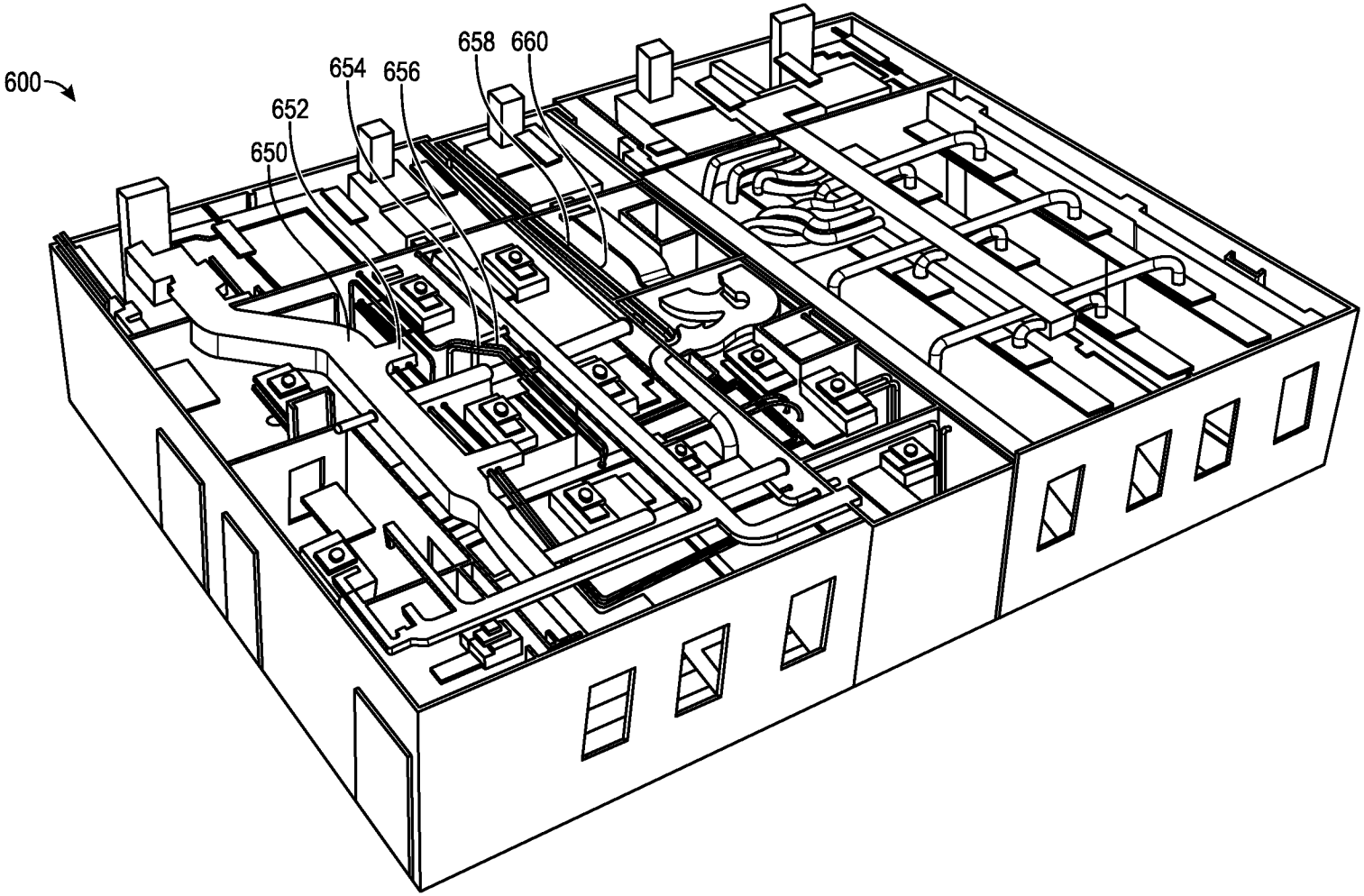
FIG. 6 is a top, side isometric view of interstitial space of an assembled modular building in accordance with an embodiment.

FIG. 6 is a top, side isometric view of interstitial space of an assembled modular building. System 600 includes HVAC ductwork 650, which connects with air handling duct 652. Electrical conduit 654 feeds electrical outlets. Conduit 656 carries network and alarm cables. Pipes 658 feed air outlets, and pipes 560 send chilled water to utility panel access points in the cleanroom below. Some pipes convey pressurized gas to the utility panels as well. Some of the various electrical conduit, pipes, ductwork, and wires can travel through the interstitial volume from a mechanical room to their respective ends in the cleanroom. However, laying them laterally over the joined modular building sections can reduce the amount of material needed.

Figure 7:
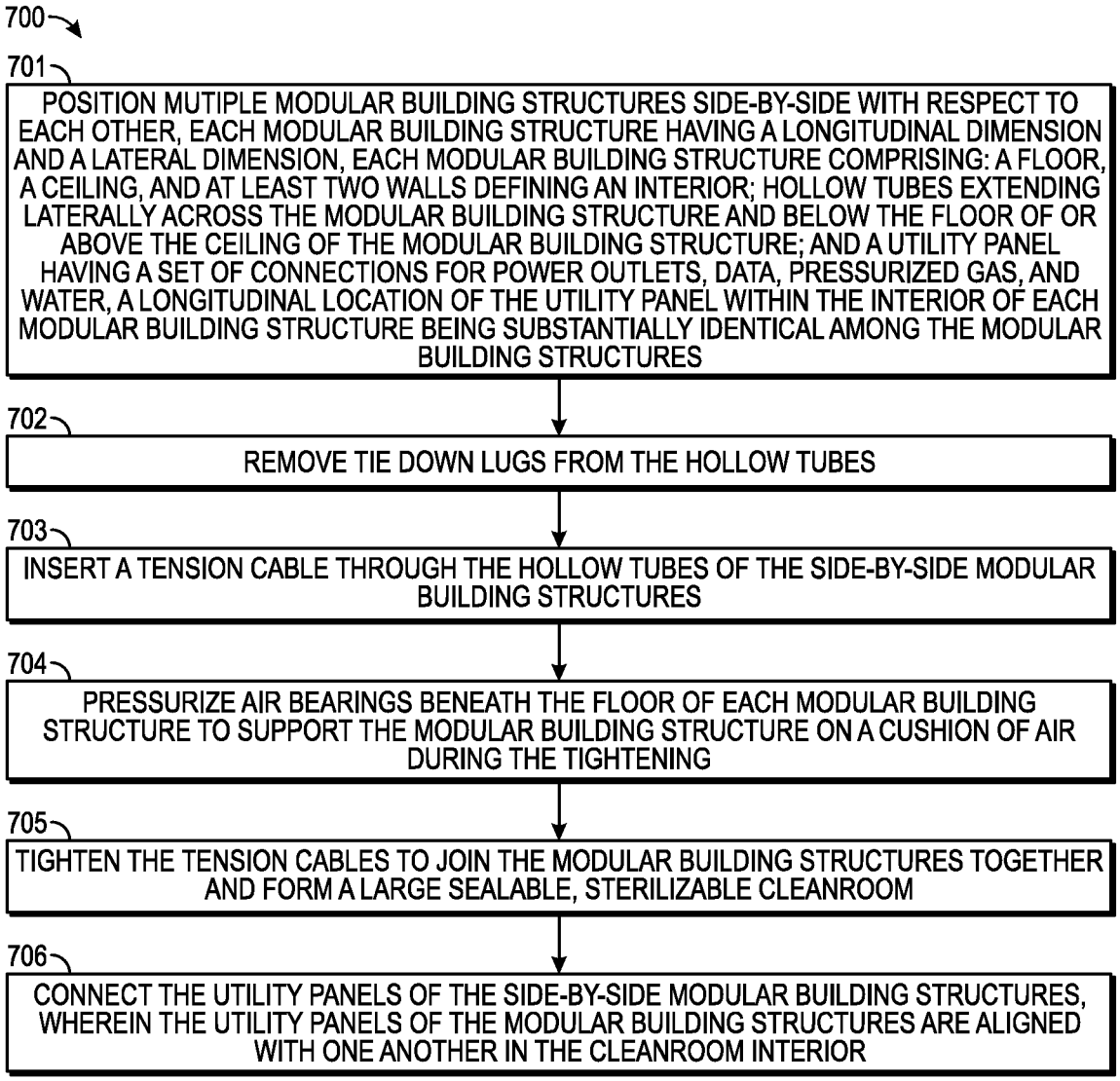
FIG. 7 is a flowchart illustrating an embodiment in accordance with the present invention.

FIG. 7 is a flowchart of a process 700 in accordance with an embodiment. In operation 701, multiple modular building structures are positioned side-by-side with respect to each other, each modular building structure having a longitudinal dimension and a lateral dimension, each modular building structure comprising a floor, a ceiling, and at least two walls defining an interior. Each modular building structure also includes hollow tubes extending laterally across the modular building structure and below the floor of, or above the ceiling of, the modular building structure. They each include a utility panel having a set of connections for power outlets, data, pressurized gas, and water, a longitudinal location of the utility panel within the interior of each modular building structure being substantially identical among the modular building structures. In operation 702, tie down lugs are removed from the hollow tubes. In operation 703, a tension cable is inserted through the hollow tubes of the side-by-side modular building structures. In operation 704, air bearings beneath the floor of each modular building structure are pressurized to support the modular building structure on a cushion of air during the tightening. In operation 705, the tension cables are tightened to join the modular building structures together and form a large sealable, sterilizable cleanroom. In operation 706, the utility panels of the side-by-side modular building structures are connected, wherein the utility panels of the modular building structures are aligned with one another in the cleanroom interior.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize or will be able to ascertain using no more than routine experimentation, numerous equivalents to the specific procedures described herein. Such equivalents are considered to be within the scope of this invention and are covered by the claims.

All publications and patent applications mentioned in the specification are indicative of the level of skill of those skilled in the art to which this invention pertains. All publications and patent applications are herein incorporated by reference to the same extent as if each individual publication or patent application was specifically and individually indicated to be incorporated by reference.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, MB, BBC, AAABCCCC, CBBAAA, CABABB, and so forth. The skilled artisan will understand that typically there is no limit on the number of items or terms in any combination, unless otherwise apparent from the context.

As used herein, words of approximation such as, without limitation, "about", "substantial" or "substantially" refers to a condition that when so modified is understood to not necessarily be absolute or perfect but would be considered close enough to those of ordinary skill in the art to warrant designating the condition as being present. The extent to which the description may vary will depend on how great a change can be instituted and still have one of ordinary skilled in the art recognize the modified feature as still having the required characteristics and capabilities of the unmodified feature. In general, but subject to the preceding discussion, a numerical value herein that is modified by a word of approximation such as "about" may vary from the stated value by at least ±1, 2, 3, 4, 5, 6, 7, 10, 12 or 15%.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A rapid deployment cleanroom system comprising:

multiple modular building structures positioned side-by-side with respect to each other, each modular building structure having a longitudinal dimension and a lateral dimension, each modular building structure comprising:

a floor, a ceiling, and at least two walls defining an interior;

hollow tubes extending laterally across and below the floor or above the ceiling; and in two or more of the modular building structures, a utility panel having a set of connections for power outlets, data, pressurized gas, and water, a longitudinal location of the utility panel within the interior of each of the two or more modular building structures being substantially identical among the modular building structures; and fasteners within the hollow tubes of the modular building structures configured to join the modular building structures together, wherein the joined modular building structures form a large sealable, sterilizable cleanroom, wherein the utility panels of the modular building structures are aligned with one another in the cleanroom interior.

2. The cleanroom system of claim 1 wherein the fasteners include tension cables extending through the hollow tubes and between opposite sides of the joined modular building structures.

3. The cleanroom system of claim 2 further comprising:

alignment blocks placed between the modular building structures.

4. The cleanroom system of claim 1 further comprising:

air bearings beneath the floor of each modular building structure configured to support the modular building structure on a cushion of air to facilitate joining them together.

5. The cleanroom system of claim 1 wherein a number and type of connections in each set are substantially identical between utility panels in different modular building structures.

6. The cleanroom system of claim 1 wherein the utility panels are located on ceilings of the modular building structures.

7. The cleanroom system of claim 1 further comprising:

gas pipes extending laterally over the modular building structures and connecting the pressurized gas connections; and water pipes collocated with the gas pipes extending laterally over the modular building structures and connecting the water connections.

8. The cleanroom system of claim 1 further comprising:

electrical conduit extending laterally across the modular building structures and connecting the power outlets; and data cables extending laterally across the modular building structures and connecting the data connections.

9. The cleanroom system of claim 8 wherein the electrical conduit includes flexible conduit and junction boxes between the modular building structures.

10. The cleanroom system of claim 1 wherein each modular building structure further comprises:

an air vent opening to the interior;

an air handling duct connected with the air vent; and the cleanroom system includes ductwork extending laterally across the modular building structures and connecting the air vents.

11. The cleanroom system of claim 1 wherein the large sealable, sterilizable cleanroom includes an area that is uninterrupted by pillars or structural walls.

12. A method of assembling modular building structures into a larger ballroom-style cleanroom, the method comprising:

positioning multiple modular building structures side-by-side with respect to each other, each modular building structure having a longitudinal dimension and a lateral dimension, each modular building structure comprising:

a floor, a ceiling, and at least two walls defining an interior;

hollow tubes extending laterally across and below the floor or above the ceiling; and in two or more of the modular building structures, a utility panel having a set of connections for power outlets, data, pressurized gas, and water, a longitudinal location of the utility panel within the interior of each of the two or more modular building structures being substantially identical among the modular building structures;

removing tie down lugs from the hollow tubes;

inserting a tension cable through the hollow tubes of the side-by-side modular building structures;

tightening the tension cables to join the modular building structures together and form a large sealable, sterilizable cleanroom; and connecting the utility panels of the side-by-side modular building structures, wherein the utility panels of the modular building structures are aligned with one another in the cleanroom interior.

13. The method of claim 12 further comprising:

pressurizing air bearings beneath the floor of each modular building structure to support the modular building structure on a cushion of air during the tightening.

14. The method of claim 12 wherein a number and type of connections in each set are substantially identical between utility panels in different modular building structures.

15. The method of claim 12 wherein the utility panels are located on ceilings of the modular building structures.

16. The method of claim 12 wherein the connecting includes:

connecting the pressurized gas connections with gas pipes extending laterally over the modular building structures; and connecting the water connections with water pipes collocated with the gas pipes extending laterally over the modular building structures.

17. The method of claim 12 wherein the connecting includes:

connecting the power outlets with electrical conduit extending laterally across the modular building structures; and connecting the data connections with data cables extending laterally across the modular building structures.

18. The method of claim 17 wherein the electrical conduit includes flexible conduit and junction boxes between the modular building structures.

19. The method of claim 12 wherein each modular building structure further comprises an air vent opening to the interior and an air handling duct connected with the air vent, the method further comprising:

connecting the air vents with ductwork extending laterally across the modular building structures.

20. The method of claim 12 wherein the large sealable, sterilizable cleanroom includes an area that is uninterrupted by pillars or structural walls.

* * * * *